US011308915B2

(12) United States Patent
Cheng

(10) Patent No.: US 11,308,915 B2
(45) Date of Patent: Apr. 19, 2022

(54) PHOTOELECTRIC SELECTION SIGNAL CONTROL CIRCUIT, DISPLAY APPARATUS, DISPLAY METHOD AND CONTROL APPARATUS

(71) Applicant: BOE TECHNOLOGY GROUP CO., LTD., Beijing (CN)

(72) Inventor: Xinyi Cheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/975,531

(22) PCT Filed: Jan. 22, 2020

(86) PCT No.: PCT/CN2020/073789
§ 371 (c)(1),
(2) Date: Aug. 25, 2020

(87) PCT Pub. No.: WO2020/156434
PCT Pub. Date: Aug. 6, 2020

(65) Prior Publication Data

US 2021/0035529 A1 Feb. 4, 2021

(30) Foreign Application Priority Data

Jan. 29, 2019 (CN) ..... 201910086427.0

(51) Int. Cl.
*G09G 3/20* (2006.01)
*G09G 5/10* (2006.01)

(52) U.S. Cl.
CPC ..... *G09G 5/10* (2013.01); *G09G 3/20* (2013.01); *G09G 2310/08* (2013.01); *G09G 2360/14* (2013.01); *G09G 2380/04* (2013.01)

(58) Field of Classification Search
CPC ..... G09G 5/10; G09G 3/20; G09G 2310/08; G09G 2360/14; G09G 2380/04
See application file for complete search history.

(56) References Cited

U.S. PATENT DOCUMENTS 9,252,184 B2 * 2/2016 Amikawa ..... H01L 27/14621
10,649,250 B2 5/2020 Xi et al.
(Continued)

FOREIGN PATENT DOCUMENTS

CN 101276424 A 10/2008
CN 103916195 A 7/2014
(Continued)

OTHER PUBLICATIONS

International Search Report of PCT/CN2020/073789 in Chinese, dated Apr. 20, 2020 with English Translation.
(Continued)

*Primary Examiner* — Michael A Faragalla
(74) *Attorney, Agent, or Firm* — Collard & Roe, P.C.

(57) ABSTRACT

A photoelectric selection signal control circuit, a display apparatus, a display method and a control apparatus. The photoelectric selection signal control circuit comprises an output circuit and at least one signal control circuit. The signal control circuit is configured to output a comparison result signal under the control of a selection signal and an illumination signal; and the output circuit is configured to output an output signal according to the comparison result signal.

17 Claims, 6 Drawing Sheets

(56) References Cited

U.S. PATENT DOCUMENTS

| | | | | |
|---|---|---|---|---|
| 2018/0203276 | A1* | 7/2018 | Xi | H01L 27/1443 |
| 2018/0247099 | A1* | 8/2018 | Liu | G06K 9/0008 |
| 2019/0013799 | A1* | 1/2019 | Sakakibara | H03K 5/08 |
| 2021/0035529 | A1 | 2/2021 | Cheng | |

FOREIGN PATENT DOCUMENTS

| | | | |
|---|---|---|---|
| CN | 104504422 | A | 4/2015 |
| CN | 107895594 | A | 4/2018 |
| CN | 108022559 | A | 5/2018 |
| CN | 207337432 | U | 5/2018 |
| CN | 108182462 | A | 6/2018 |
| CN | 207965932 | U | 10/2018 |
| CN | 109616038 | A | 4/2019 |

OTHER PUBLICATIONS

Written Opinion of the International Searching Authority of PCT/CN2020/073789 in Chinese, dated Apr. 20, 2020.
Chinese Office Action in Chinese Application No. 201910086427.0, dated Mar. 23, 2020 with English translation.

* cited by examiner

PHOTOELECTRIC SELECTION SIGNAL CONTROL CIRCUIT, DISPLAY APPARATUS, DISPLAY METHOD AND CONTROL APPARATUS

CROSS REFERENCE TO RELATED APPLICATIONS

This application is the National Stage of PCT/CN2020/073789 filed on Jan. 22, 2020, which claims priority under 35 U.S.C. § 119 of Chinese Application No. 201910086427.0 filed on Jan. 29, 2019, the disclosure of which is incorporated by reference.

TECHNICAL FIELD

Embodiments of the present disclosure relate to a photoelectric selection signal control circuit, a display device and a display method thereof, and a control device.

BACKGROUND

The use of electronic labels eliminates the need for paper labels in supermarkets. For example, the contents and prices of merchandise in the electronic labels can be changed by such as servers and wireless access points (AP). The use of electronic labels with strip-shaped screens can save the cost of the electronic labels. For example, one strip-shaped screen can display multiple label contents of merchandise. However, the label displayed on the strip-shaped screen should correspond to the merchandise placed at the location where the label is located, and the position of the merchandise is often adjusted, so that the position of the label on the strip-shaped screen needs to be adjusted from time to time.

SUMMARY

At least one embodiment of the present disclosure provides a photoelectric selection signal control circuit, and the photoelectric selection signal control circuit includes an output circuit and at least one signal control circuit; the signal control circuit is configured to output a comparison result signal under control of a selection signal and a lighting signal; and the output circuit is configured to output an output signal according to the comparison result signal.

For example, in the photoelectric selection signal control circuit provided by at least one embodiment of the present disclosure, the signal control circuit includes: an input circuit, configured to receive a first voltage signal and output a first control signal under control of the selection signal; a photosensitive circuit, configured to output a second control signal according to the first control signal under control of the lighting signal; and a comparison circuit, configured to compare the second control signal with a second voltage signal different from the first voltage signal and output the comparison result signal.

For example, in the photoelectric selection signal control circuit provided by at least one embodiment of the present disclosure, the photosensitive circuit includes a phototransistor, a collector electrode of the phototransistor is connected to the input circuit and configured to receive the first control signal, an emitter electrode of the phototransistor is connected to the comparison circuit and configured to output the second control signal, and a base electrode of the phototransistor is configured to receive the lighting signal.

For example, in the photoelectric selection signal control circuit provided by at least one embodiment of the present disclosure, the input circuit includes a transistor, a control electrode of the transistor is configured to receive the selection signal, a first electrode of the transistor is configured to receive the first voltage signal, and a second electrode of the transistor is connected to the photosensitive circuit and configured to output the first control signal.

For example, in the photoelectric selection signal control circuit provided by at least one embodiment of the present disclosure, the comparison circuit includes a comparator, a non-inverting input terminal of the comparator is connected to the photosensitive circuit and configured to receive the second control signal, an inverting input terminal of the comparator is configured to receive the second voltage signal, and an output terminal of the comparator is configured to output the comparison result signal.

For example, the photoelectric selection signal control circuit provided by at least one embodiment of the present disclosure further includes a plurality of signal control circuits, and the plurality of signal control circuits transmit comparison result signals output by the plurality of signal control circuits to the output circuit, respectively.

For example, in the photoelectric selection signal control circuit provided by at least one embodiment of the present disclosure, the plurality of signal control circuits are connected in parallel with each other.

For example, in the photoelectric selection signal control circuit provided by at least one embodiment of the present disclosure, the output circuit includes an OR gate, an input terminal of the OR gate is connected to the signal control circuit and configured to receive the comparison result signal, and an output terminal of the OR gate is configured to output the output signal.

At least one embodiment of the present disclosure further provides a display device, and the display device includes a control circuit, a display element, and the photoelectric selection signal control circuit according to any one of the embodiments of the present disclosure; and the control circuit is configured to generate the selection signal and output the selection signal to the signal control circuit of the photoelectric selection signal control circuit, and is configured to control the display element to display according to the output signal of the output circuit of the photoelectric selection signal control circuit.

For example, in the display device provided by at least one embodiment of the present disclosure, the photoelectric selection signal control circuit includes a plurality of signal control circuits, the selection signal selects and turns on an input circuit of only one signal control circuit of the plurality of signal control circuits at any moment, and the control circuit is configured to determine whether to start a decoding step at a current moment according to the output signal of the photoelectric selection signal control circuit, and is configured to continuously generate and output the selection signal to an input circuit selected at the current moment and continuously receive and decode the output signal to obtain authentication information and to enable a display control function in a case where the decoding step is started.

For example, the display device provided by at least one embodiment of the present disclosure further includes a signal receiving circuit, the signal receiving circuit is configured to receive a label control signal, the control circuit is configured to control a display state of a label according to the label control signal, and the display element is configured to display the label according to the display state.

For example, in the display device provided by at least one embodiment of the present disclosure, the display element is configured to display a plurality of labels, each label of the plurality of labels corresponds to one signal control circuit of the plurality of signal control circuits, and a position corresponding to the each label is provided with a photosensitive circuit of the one signal control circuit; the display state includes a label position state; the control circuit is configured to determine a corresponding photosensitive circuit according to the input circuit selected at the current moment, determine a label corresponding to the label control signal according to a location of the photosensitive circuit, and control the label position state of the label according to the label control signal; and the display element is configured to display the label according to the label position state.

For example, in the display device provided by at least one embodiment of the present disclosure, a plurality of photosensitive circuits of the plurality of signal control circuits include a photosensitive circuit provided on one side of the display element; the display state includes a label arrangement state; the control circuit is configured to control the label arrangement state of the label according to the label control signal if a photosensitive circuit corresponding to the input circuit selected at the current moment is the photosensitive circuit provided on the one side of the display element; and the display element is configured to display the label according to the label arrangement state.

For example, in the display device provided by at least one embodiment of the present disclosure, the output signal includes a preamble code, a synchronization code, a data code, and a verification code, the preamble code is used to start the decoding step, the synchronization code is used to provide synchronization of timing, the data code includes data information to be transmitted, and the verification code is used to verify whether transmitted data information is correct.

At least one embodiment of the present disclosure further provides a control device, and the control device includes: a trigger circuit, configured to receive a trigger instruction from a user and send out a trigger signal; a signal generation circuit, configured to generate a lighting signal based on a preset code according to the trigger signal; and a signal sending circuit, configured to transmit the lighting signal to a photosensitive circuit of a photoelectric selection signal control circuit.

For example, in the control device provided by at least one embodiment of the present disclosure, the lighting signal includes a preamble code, a synchronization code, a data code, and a verification code, the preamble code is used to start a decoding step, the synchronization code is used to provide synchronization of timing, the data code includes data information to be transmitted, and the verification code is used to verify whether transmitted data information is correct.

For example, in the control device provided by at least one embodiment of the present disclosure, the trigger circuit includes at least one button, and the button sends out the trigger signal when being pressed.

At least one embodiment of the present disclosure further provides a display system, and the display system includes the display device according to any one of the embodiments of the present disclosure, and the control device according to any one of the embodiments of the present disclosure.

At least one embodiment of the present disclosure further provides a display method applied to the display device according to any one of the embodiments of the present disclosure, and the display method includes: using the control circuit to generate the selection signal and output the selection signal to the signal control circuit of the photoelectric selection signal control circuit; and using the control circuit to control the display element to display according to the output signal of the output circuit of the photoelectric selection signal control circuit.

For example, in the display method provided by at least one embodiment of the present disclosure, the photoelectric selection signal control circuit includes a plurality of signal control circuits, the selection signal selects and turns on an input circuit of only one signal control circuit of the plurality of signal control circuits at any moment, and the display method further includes: using the control circuit to determine whether to start a decoding step at a current moment according to the output signal of the photoelectric selection signal control circuit; and using the control circuit to continuously generate and output the selection signal to an input circuit selected at the current moment, and using the control circuit to continuously receive and decode the output signal to obtain authentication information and enable a display control function, after the decoding step is started.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect," "connected," "coupled," etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
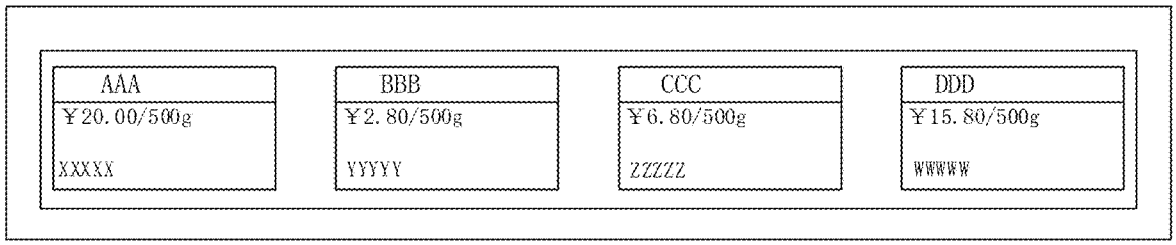
FIG. 1 is a schematic diagram of a strip-shaped screen for displaying electronic labels.

FIG. 1 is a schematic diagram of a strip-shaped screen for displaying electronic labels. For example, as illustrated in FIG. 1, a strip-shaped screen may display a plurality of electronic labels, and each electronic label includes merchandise information such as the merchandise name, price, place of production, specifications, etc. Because the electronic label needs to be consistent with the merchandise placed at the position where the electronic label is located, when the position of the merchandise is adjusted, the display position of the electronic label on the strip-shaped screen needs to be adjusted accordingly.

At present, the strip-shaped screen usually adopts, for example, a touch screen, and the display position of the electronic label on the strip-shaped screen is adjusted by means of touch control. For example, the touch screen may be a capacitive touch screen, a resistive touch screen, an infrared sensing touch screen, etc. The advantage of the touch control method is that the operation is simple, and the electronic label can be directly dragged to the corresponding display position on the strip-shaped screen. However, the touch control method requires the additional authentication information and authentication system to avoid, for example, incorrect operations or other personnel operations, which may result in higher system costs for the strip-shaped screen. In addition, at present, remote-control methods such as infrared and Bluetooth remote controllers may also be used to control and adjust the display content on the strip-shaped screen, but these remote-control methods require the remote controllers to have a plurality of selection buttons, which is complicated to operate and has a high error rate, and operation records are difficult to be stored, which is not conducive to management.

At least one embodiment of the present disclosure provides a photoelectric selection signal control circuit. The photoelectric selection signal control circuit enables a signal control circuit to generate a comparison result signal under control of a selection signal and a lighting signal, and controls an output signal of an output circuit according to the comparison result signal, so that the photoelectric selection signal control circuit implements signal output under control of the selection signal and the lighting signal. Therefore, the photoelectric selection signal control circuit is jointly controlled by the selection signal and the lighting signal to achieve a circuit of selection mechanism, thereby optimizing the structure of the photoelectric selection signal control circuit, enabling the control method of the photoelectric selection signal control circuit to be simple and convenient, and facilitating practical application.

Hereinafter, the embodiments of the present disclosure will be described in detail with reference to the drawings. It should be noted that the same reference numerals in different drawings are used to refer to the same elements which have been described.

Figure 2:
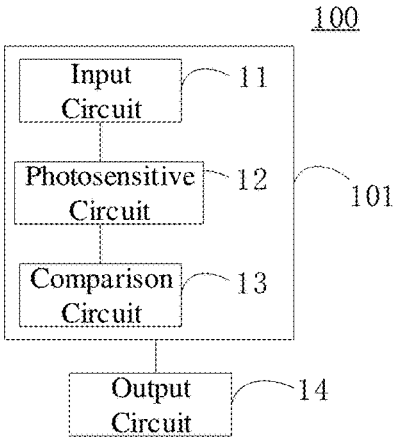
FIG. 2 is a schematic block diagram of a photoelectric selection signal control circuit provided by some embodiments of the present disclosure.

FIG. 2 is a schematic block diagram of a photoelectric selection signal control circuit provided by some embodiments of the present disclosure.

For example, as illustrated in FIG. 2, the photoelectric selection signal control circuit 100 includes an output circuit 14 and at least one signal control circuit, for example, the signal control circuit 101. The signal control circuit 101 is configured to output a comparison result signal under control of a selection signal and a lighting signal, and the output circuit 14 is configured to output an output signal according to the comparison result signal.

The photoelectric selection signal control circuit provided by the embodiments of the present disclosure enables the photoelectric selection signal control circuit to implement signal output under control of the selection signal and the lighting signal by being provided with the signal control circuit and the output circuit. Therefore, the photoelectric selection signal control circuit is jointly controlled by the selection signal and the lighting signal to achieve a circuit of selection mechanism, thereby optimizing the structure of the photoelectric selection signal control circuit, enabling the control method of the photoelectric selection signal control circuit to be simple and convenient, and facilitating practical application.

Figure 3:
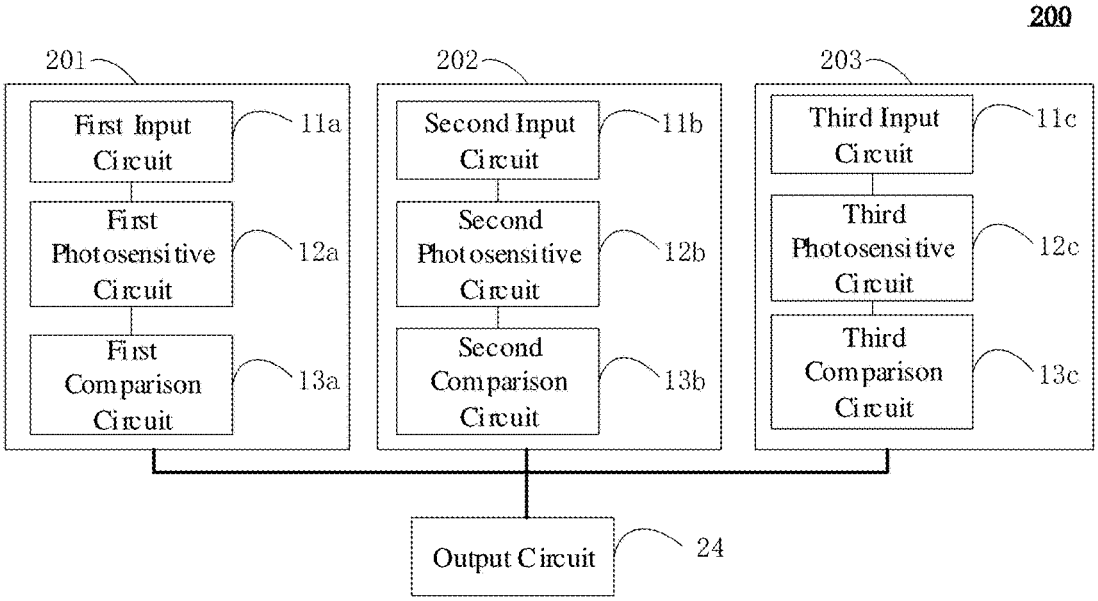
FIG. 3 is a schematic block diagram of another photoelectric selection signal control circuit provided by some embodiments of the present disclosure.

It should be noted that the photoelectric selection signal control circuit provided by the embodiments of the present disclosure may include one signal control circuit as illustrated in FIG. 2, or may include a plurality of signal control circuits as illustrated in FIG. 3 (referring to the description of the embodiment illustrated in FIG. 3 below), and the embodiments of the present disclosure are not limited in this aspect.

For example, as illustrated in FIG. 2, the signal control circuit 101 of the photoelectric selection signal control circuit 100 includes an input circuit 11, a photosensitive circuit 12, and a comparison circuit 13.

For example, the input circuit 11 is configured to receive a first voltage signal and output a first control signal under control of the selection signal.

For example, the photosensitive circuit 12 is configured to output a second control signal according to the first control signal under control of the lighting signal.

For example, the comparison circuit 13 is configured to compare the second control signal with a second voltage signal different from the first voltage signal and output the comparison result signal.

In some embodiments, the first voltage signal and the second voltage signal may be set according to actual needs. For example, the first voltage signal may be set as a high-level signal, and the second voltage signal may be set as a low-level signal. The embodiments of the present disclosure are not limited in this aspect.

By being provided with the input circuit, the photosensitive circuit, the comparison circuit, and the output circuit, the photoelectric selection signal control circuit provided by the embodiments of the present disclosure can generate the second control signal when the input circuit is turned on by the selection signal and the photosensitive circuit is turned on by receiving the lighting signal, and the second control signal is compared with the second voltage signal to output the comparison result signal, so as to enable the output circuit to output the output signal according to the comparison result signal, so that the output circuit may implement signal output under joint control of the selection signal and the lighting signal. The photoelectric selection signal control circuit provided by the embodiments of the present disclosure is jointly controlled by the lighting signal and the selection signal, so as to be designed as a circuit of selection mechanism, thereby optimizing the structure of the photoelectric selection signal control circuit, enabling the control method of the photoelectric selection signal control circuit to be simple and convenient, and facilitating practical application.

In some embodiments, the photoelectric selection signal control circuit may include a plurality of signal control circuits, and the plurality of signal control circuits transmit comparison result signals output by the signal control circuits to the output circuit, respectively.

For example, in the case where the photoelectric selection signal control circuit includes the plurality of signal control circuits, the number of input circuits, the number of photosensitive circuits, and the number of comparison circuits are all multiple and the same. Each photosensitive circuit is correspondingly connected to an input circuit and a comparison circuit, and the comparison result signal output by each comparison circuit is transmitted to the output circuit. In this way, the plurality of signal control circuits including the input circuits, the photosensitive circuits, and the comparison circuits can achieve signal output of a plurality of branches.

In some embodiments, the plurality of signal control circuits are connected in parallel with each other.

For example, taking the photoelectric selection signal control circuit 200 including three signal control circuits illustrated in FIG. 3 as an example, the photoelectric selection signal control circuit 200 includes three branches, that is, a first signal control circuit 201, a second signal control circuit 202, and a third signal control circuit 203. The first branch (for example, the first signal control circuit 201) includes a first input circuit 11*a*, a first photosensitive circuit 12*a*, and a first comparison circuit 13*a*, the second branch (for example, the second signal control circuit 202) includes a second input circuit 11*b*, a second photosensitive circuit 12*b*, and a second comparison circuit 13*b*, and the third branch (for example, the third signal control circuit 203) includes a third input circuit 11*c*, a third photosensitive circuit 12*c*, and a third comparison circuit 13*c*. The comparison circuits of the three branches are all connected to the output circuit 24.

Thus, the comparison result signals of the first signal control circuit 201, the second signal control circuit 202, and the third signal control circuit 203 are all transmitted to the output circuit 24, and the output circuit 24 may implement signal output according to the comparison result signals of the three signal control circuits.

It should be noted that the contents of the input circuit, the photosensitive circuit, the comparison circuit, and the output circuit of the photoelectric selection signal control circuit 200 illustrated in FIG. 3 may refer to the corresponding descriptions of the photoelectric selection signal control circuit 100 illustrated in FIG. 2, and details are not described herein again.

In some embodiments of the present disclosure, the photosensitive circuit includes a phototransistor. A collector electrode of the phototransistor is connected to the input circuit and configured to receive the first control signal, an emitter electrode of the phototransistor is connected to the comparison circuit and configured to output the second control signal, and a base electrode of the phototransistor is configured to receive the lighting signal.

In some embodiments of the present disclosure, the input circuit includes a transistor. A control electrode of the transistor is configured to receive the selection signal, a first electrode of the transistor is configured to receive the first voltage signal, and a second electrode of the transistor is connected to the photosensitive circuit and configured to output the first control signal.

In some embodiments of the present disclosure, the comparison circuit includes a comparator. A non-inverting input terminal of the comparator is connected to the photosensitive circuit and configured to receive the second control signal, an inverting input terminal of the comparator is configured to receive the second voltage signal, and an output terminal of the comparator is configured to output the comparison result signal.

In some embodiments of the present disclosure, the output circuit includes an OR gate. An input terminal of the OR gate is connected to the signal control circuit and configured to receive the comparison result signal, and an output terminal of the OR gate is configured to output the output signal.

Figure 4:
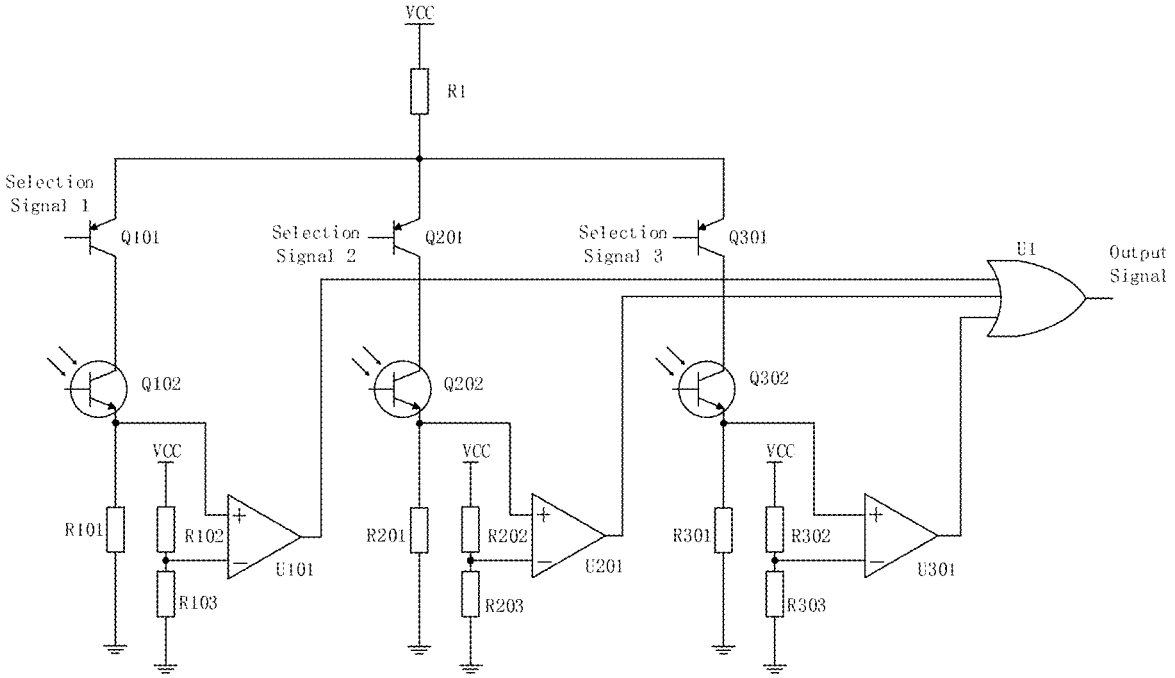
FIG. 4 is a schematic structural diagram of a photoelectric selection signal control circuit provided by some embodiments of the present disclosure.

FIG. 4 is a schematic structural diagram of a photoelectric selection signal control circuit provided by some embodiments of the present disclosure. For example, the photoelectric selection signal control circuit illustrated in FIG. 4 may be an implementation example of the photoelectric selection signal control circuit 200 illustrated in FIG. 3.

Hereinafter, taking the case where the photoelectric selection signal control circuit 200 illustrated in FIG. 3 is implemented by using the circuit structure illustrated in FIG. 4 as an example, the specific structure of the photoelectric selection signal control circuit 200 provided by the embodiments of the present disclosure is described with reference to FIG. 3 and FIG. 4.

For example, as illustrated in FIG. 3 and FIG. 4, the first input circuit 11*a* includes a first transistor Q101, the second input circuit 11*b* includes a second transistor Q201, and the third input circuit 11*c* includes a third transistor Q301. The first photosensitive circuit 12*a* includes a first phototransistor Q102, the second photosensitive circuit 12*b* includes a second phototransistor Q202, and the third photosensitive circuit 12*c* includes a third phototransistor Q302. The first comparison circuit 13*a* includes a first comparator U101, the second comparison circuit 13*b* includes a second comparator U201, and the third comparison circuit 13*c* includes a third comparator U301. The output circuit 24 includes an OR gate U1.

For example, referring to FIG. 3 and FIG. 4, the input terminal of the OR gate U1 is connected to the comparison circuit, for example, connected to the first comparator U101, the second comparator U201, and the third comparator U301, respectively, and is configured to receive the comparison result signal. The output terminal of the OR gate U1 is configured to output the output signal.

For example, when the comparison result signal output by any comparison circuit of the three branches (for example, any one of the first comparator U101, the second comparator U201, and the third comparator U301) is a high-level signal, the output terminal of the OR gate U1 of the output circuit 24 may output the output signal with a high level.

For example, referring to FIG. 3 and FIG. 4, the photoelectric selection signal control circuit includes three branches (i.e., the first signal control circuit 201, the second signal control circuit 202, and the third signal control circuit 203) and the OR gate U1, and each branch includes a transistor, a phototransistor and a comparator.

For example, the first branch includes the first transistor Q101, the first phototransistor Q102, and the first comparator U101. The control electrode of the first transistor Q101 is used to receive a selection signal 1, the first electrode of the first transistor Q101 is used to receive the first voltage signal, and the second electrode of the first transistor Q101 is used to connect the collector electrode of the first phototransistor Q102 and output the first control signal to the first phototransistor Q102. The emitter electrode of the first phototransistor Q102 is connected to the non-inverting input terminal of the first comparator U101 and outputs the second control signal to the first comparator U101, and the base electrode of the first phototransistor Q102 is used to receive the lighting signal. The inverting input terminal of the first comparator U101 is used to receive the second voltage signal, and the output terminal of the first comparator U101 is used to output the comparison result signal to the OR gate U1.

For example, the first branch further includes a grounded resistor R101, and the grounded resistor R101 is used to connect the emitter electrode of the first phototransistor Q102 to the ground, thereby improving the stability of the first branch in the turn-on state.

For example, the first branch further includes voltage dividing resistors R102 and R103 which are connected with each other in series, a first end of the voltage dividing resistor R102 is provided with a power supply voltage signal VCC, a second end of the voltage dividing resistor R102 is connected to a first end of the voltage dividing resistor R103, and a second end of the voltage dividing resistor R103 is grounded. Thus, the voltage dividing resistors R102 and R103 divide the power supply voltage signal VCC to form the second voltage signal at the junction of the voltage dividing resistors R102 and R103 (for example, the second end of the voltage dividing resistor R102 or the first end of the voltage dividing resistor R103), so that the second voltage signal may be input to the inverting input terminal of the first comparator U101 for signal comparison.

For example, the second branch includes the second transistor Q201, the second phototransistor Q202, and the second comparator U201. The control electrode of the second transistor Q201 is used to receive a selection signal 2, the first electrode of the second transistor Q201 is used to receive the first voltage signal, and the second electrode of the second transistor Q201 is used to connect the collector electrode of the second phototransistor Q202 and output the first control signal to the second phototransistor Q202. The emitter electrode of the second phototransistor Q202 is connected to the non-inverting input terminal of the second comparator U201 and outputs the second control signal to the second comparator U201, and the base electrode of the second phototransistor Q202 is used to receive the lighting signal. The inverting input terminal of the second comparator U201 is used to receive the second voltage signal, and the output terminal of the second comparator U201 is used to output the comparison result signal to the OR gate U1.

For example, the second branch further includes a grounded resistor R201, and the grounded resistor R201 is used to connect the emitter electrode of the second phototransistor Q202 to the ground, thereby improving the stability of the second branch in the turn-on state.

For example, the second branch further includes voltage dividing resistors R202 and R203 which are connected with each other in series, a first end of the voltage dividing resistor R202 is provided with the power supply voltage signal VCC, a second end of the voltage dividing resistor R202 is connected to a first end of the voltage dividing resistor R203, and a second end of the voltage dividing resistor R203 is grounded. Thus, the voltage dividing resistors R202 and R203 divide the power supply voltage signal VCC to form the second voltage signal at the junction of the voltage dividing resistors R202 and R203 (for example, the second end of the voltage dividing resistor R202 or the first end of the voltage dividing resistor R203), so that the second voltage signal may be input to the inverting input terminal of the second comparator U201 for signal comparison.

For example, the third branch includes the third transistor Q301, the third phototransistor Q302, and the third comparator U301. The control electrode of the third transistor Q301 is used to receive a selection signal 3, the first electrode of the third transistor Q301 is used to receive the first voltage signal, and the second electrode of the third transistor Q301 is used to connect the collector electrode of the third phototransistor Q302 and output the first control signal to the third phototransistor Q302. The emitter electrode of the third phototransistor Q302 is connected to the non-inverting input terminal of the third comparator U301 and outputs the second control signal to the third comparator U301, and the base electrode of the third phototransistor Q302 is used to receive the lighting signal. The inverting input terminal of the third comparator U301 is used to receive the second voltage signal, and the output terminal of the third comparator U301 is used to output the comparison result signal to the OR gate U1.

For example, the third branch further includes a grounded resistor R301, and the grounded resistor R301 is used to connect the emitter electrode of the third phototransistor Q302 to the ground, thereby improving the stability of the third branch in the turn-on state.

For example, the third branch further includes voltage dividing resistors R302 and R303 which are connected with each other in series, a first end of the voltage dividing resistor R302 is provided with the power supply voltage signal VCC, a second end of the voltage dividing resistor R302 is connected to a first end of the voltage dividing resistor R303, and a second end of the voltage dividing resistor R303 is grounded. Thus, the voltage dividing resistors R302 and R303 divide the power supply voltage signal VCC to form the second voltage signal at the junction of the voltage dividing resistors R302 and R303 (for example, the second end of the voltage dividing resistor R302 or the first end of the voltage dividing resistor R303), so that the second voltage signal may be input to the inverting input terminal of the third comparator U301 for signal comparison.

For example, the photoelectric selection signal control circuit further includes a resistor R1. A first end of the resistor R1 is provided with the power supply voltage signal VCC, and a second end of the resistor R1 is connected to the first electrode of the first transistor Q101, the first electrode of the second transistor Q201, and the first electrode of the third transistor Q301, respectively. The resistor R1 is used to process the power supply voltage signal VCC into the first voltage signal to be input to each transistor.

For example, the output signal of the output terminal of the OR gate U1 may be output to, for example, a decoding circuit, which can decode the output signal to obtain data information in the output signal. For example, the decoding circuit may be a microcontroller unit (MCU), that is, a single-chip microcomputer or a microcontroller.

The working principle of the photoelectric selection signal control circuit provided by the embodiments of the present disclosure will be described below in connection with the circuit structure of the photoelectric selection signal control circuit illustrated in FIG. 4.

In the case where none of the phototransistors in the photoelectric selection signal control circuit receives the lighting signal, the second control signals received by the non-inverting input terminals of all comparators are low-level signals, and the inverting input terminals are provided with low-level signals because of the resistance division of the voltage dividing resistors, so that all the comparators output low-level signals, and the output terminal of the OR gate U1 outputs a low-level signal.

For example, taking the first transistor Q101 as a P-type transistor as an example, when the selection signal 1 is a low-level signal, the first transistor Q101 is turned on. If the first phototransistor Q102 receives the lighting signal during the period where the first transistor Q101 is turned on, the first phototransistor Q102 is turned on. Where the first phototransistor Q102 is turned on, the voltage of the second control signal received by the non-inverting input terminal of the first comparator U101 is higher than a voltage threshold set by resistor dividing at the inverting input terminal, the first comparator U101 outputs a high-level signal, and therefore, the output terminal of the OR gate U1 outputs a high-level signal. Similarly, in the case where the second transistor Q201 and the third transistor Q301 are P-type transistors, if the selection signal 2 or the selection signal 3 is a low-level signal, and the second phototransistor Q202 or the third phototransistor Q302 receives the lighting signal, the output terminal of the OR gate U1 may also output a high-level signal, and details are not described herein again.

In this way, by the combination of the selection signal and the lighting signal, the turn-on state of any branch in the photoelectric selection signal control circuit may be controlled to implement high-level signal output at the output terminal, so that the photoelectric selection signal control circuit can achieve the selection mechanism.

It should be noted that the number of the branches of the photoelectric selection signal control circuit in the foregoing embodiments, that is, the number of the signal control circuits included in the photoelectric selection signal control circuit, is merely description of an example. In some other embodiments of the present disclosure, increase or decrease of the number of the branches may be changed according to different actual needs. In addition, components in the photoelectric selection signal control circuit may also be replaced by other types of components with similar functions and are not limited to the specific component types provided in the foregoing embodiments.

It should be noted that the transistors adopted in the embodiments of the present disclosure may be thin film transistors, field effect transistors, or other switching components with the same characteristics. In the embodiments of the present disclosure, thin film transistors are used as examples for description, but this does not constitute a limitation to the embodiments of the present disclosure. The source electrode and the drain electrode of the transistor adopted here can be symmetrical in structure, so the source electrode and the drain electrode can be structurally indistinguishable. In the embodiments of the present disclosure, in order to distinguish the two electrodes (i.e., the source electrode and the drain electrode) of the transistor other than the gate electrode, one electrode is directly described as the first electrode and the other electrode is described as the second electrode.

It should be noted that the transistors in the embodiments of the present disclosure are all described by taking P-type transistors as an example. In this case, the first electrode of the transistor is the source electrode, and the second electrode of the transistor is the drain electrode. It should be noted that the present disclosure includes but is not limited to this. For example, one or more transistors in the photoelectric selection signal control circuit provided by the embodiments of the present disclosure may also adopt N-type transistor(s). In this case, the first electrode of the transistor is the drain electrode, and the second electrode of the transistor is the source electrode. The electrodes of the selected type of transistor are connected correspondingly with reference to the electrodes of the corresponding transistor in the embodiments of the present disclosure, and the corresponding voltage terminal provides the corresponding high or low voltage. In the case where N-type transistors are adopted, indium gallium zinc oxide (IGZO) may be adopted as an active layer of the thin film transistor, and compared with low temperature poly silicon (LTPS) or amorphous silicon (for example, hydrogenated amorphous silicon) being adopted as the active layer of the thin film transistor, the size of the transistor can be effectively reduced and the leakage current can be avoided.

At least one embodiment of the present disclosure further provides a display device, and the display device includes a control circuit, a display element, and the photoelectric selection signal control circuit according to any one of the embodiments of the present disclosure, such as the photoelectric selection signal control circuit 100 or the photoelectric selection signal control circuit 200 in the foregoing embodiments. The control circuit is configured to generate the selection signal and output the selection signal to the signal control circuit of the photoelectric selection signal control circuit, and is configured to control the display element to display according to the output signal of the output circuit of the photoelectric selection signal control circuit.

The display device provided by the embodiments of the present disclosure includes the photoelectric selection signal control circuit provided by any one of the embodiments of the present disclosure, so that under control of the selection signal and the lighting signal, the photoelectric selection signal control circuit with the optimized structure can be used to control the display of the display element of the display device, thereby optimizing the control method of the display element.

For example, the display device provided by the embodiments of the present disclosure may be used to display electronic labels, which can simplify the control method of the electronic labels to a certain extent, for example, can simplify the verification method during operation.

Figure 5A:
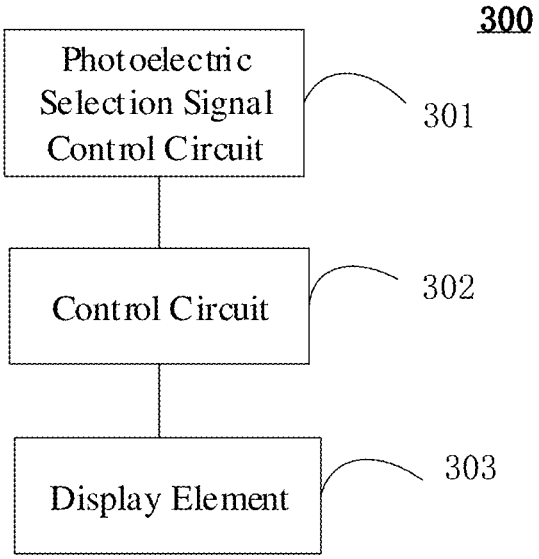
FIG. 5A is a schematic block diagram of a display device provided by some embodiments of the present disclosure.

FIG. 5A is a schematic block diagram of a display device provided by some embodiments of the present disclosure.

For example, as illustrated in FIG. 5A, the display device 300 includes a photoelectric selection signal control circuit 301, a control circuit 302, and a display element 303.

For example, the photoelectric selection signal control circuit 301 may be the photoelectric selection signal control circuit provided by any one of the embodiments of the present disclosure, such as the photoelectric selection signal control circuit 100 or the photoelectric selection signal control circuit 200 in the foregoing embodiments.

For example, the control circuit 302 is configured to generate a selection signal and output the selection signal to a signal control circuit of the photoelectric selection signal control circuit 301, and is configured to control the display element 303 to display according to the output signal of the output circuit of the photoelectric selection signal control circuit 301.

For example, in some embodiments of the present disclosure, the photoelectric selection signal control circuit includes a plurality of signal control circuits, and the selection signal selects and turns on an input circuit of only one signal control circuit of the plurality of signal control circuits at any moment. The control circuit is configured to determine whether to start a decoding step at a current moment according to the output signal of the photoelectric selection signal control circuit, and is configured to continuously generate and output the selection signal to an input circuit selected at the current moment and continuously receive and decode the output signal to obtain authentication information and to enable a display control function in a case where the decoding step is started.

The display device provided by the above-mentioned embodiment of the present disclosure enables the input circuit of only one signal control circuit of the photoelectric selection signal control circuit to be selected and turned on at a certain moment through the selection signal provided by the control circuit, so that it is possible to detect whether the signal control circuit including the input circuit that is selected and turned on receives the lighting signal at that moment according to the output signal that is obtained. Therefore, the output signal obtained at any moment may correspond to a receiving state of the lighting signal of a certain signal control circuit of the photoelectric selection signal control circuit. For example, when it is determined that a signal control circuit receives the lighting signal, the control circuit continuously outputs the selection signal to the signal control circuit to maintain the turn-on state of the input circuit of the signal control circuit, and decodes the output signal of the signal control circuit to determine whether to activate the display control function corresponding to the signal control circuit.

For example, in the case where the photoelectric selection signal control circuit includes a plurality of signal control circuits, the control circuit can be used to enable the input circuits of the plurality of signal control circuits to be sequentially selected and turned on, so as to implement sequential scanning of the plurality of signal control circuits to determine whether the lighting signal is received.

Taking the display device provided by the embodiments of the present disclosure being used for the display of electronic labels as an example, the display device provided by the embodiments of the present disclosure is described below.

Figure 5B:
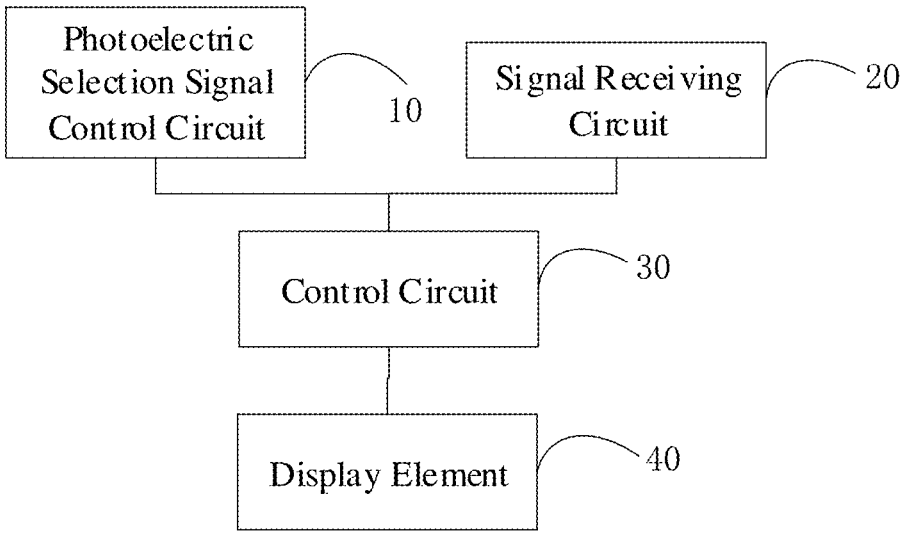
FIG. 5B is a schematic block diagram of another display device provided by some embodiments of the present disclosure.

FIG. 5B is a schematic block diagram of another display device provided by some embodiments of the present disclosure. It should be noted that, except that the display device illustrated in FIG. 5B includes a signal receiving circuit 20, other structures of the display device illustrated in FIG. 5B are basically the same as or similar to the display device 300 illustrated in FIG. 5A, and details are not described herein again.

For example, as illustrated in FIG. 5B, the display device includes a photoelectric selection signal control circuit 10, a signal receiving circuit 20, a control circuit 30, and a display element 40. For example, the photoelectric selection signal control circuit 10 may be the photoelectric selection signal control circuit provided by any one of the embodiments of the present disclosure, such as the photoelectric selection signal control circuit 100 or the photoelectric selection signal control circuit 200 in the above-mentioned embodiments. The embodiments of the present disclosure are not limited in this aspect.

For example, the signal receiving circuit 20 is configured to receive a label control signal. For example, the label control signal can be used to control a display state of a label. For example, the label control signal may include a signal for controlling a label position state of the label and a signal for controlling a label arrangement state of the label.

For example, the control circuit 30 is configured to control the display state of the label according to the label control signal, and the display element 40 is configured to display the label according to the display state.

In the following, taking the photoelectric selection signal control circuit 10 adopting the circuit structure illustrated in FIG. 4 as an example, the functions of elements or components of the display device illustrated in FIG. 5B are described in combination with the embodiments of the photoelectric selection signal control circuits illustrated in FIG. 3 and FIG. 4.

For example, the control circuit 30 is used to generate a selection signal and output the selection signal to the input circuit (for example, the first input circuit 11*a*, the second input circuit 11*b*, or the third input circuit 11*c*) of the photoelectric selection signal control circuit 10 (for example, the photoelectric selection signal control circuit 200). The selection signal selects and turns on only one of the first input circuit 11*a*, the second input circuit 11*b*, and the third input circuit 11*c* at any one moment. For example, the selection process of the selection signal may be to sequentially select and turn on each of the branches in the photoelectric selection signal control circuit 10. For example, the first branch is selected and turned on in a first period, the second branch is selected and turned on in a second period, the third branch is selected and turned on in a third period, and so on.

For example, the control circuit 30 is further configured to determine whether to start the decoding step at the current moment according to the output signal of the photoelectric selection signal control circuit 10. Here, referring to the foregoing embodiments of the photoelectric selection signal control circuit, for example, in the case where the output signal of the output terminal of the photoelectric selection signal control circuit 10 is a high-level signal, the decoding step is started, otherwise the decoding step is not started. For example, in the case where the output signal of the output terminal of the photoelectric selection signal control circuit 10 is a low-level signal, the decoding step is not started.

For example, the control circuit 30 is further configured to continuously generate and output the selection signal to the input circuit selected at the current moment after the decoding step is started. For example, the input circuit selected at the current moment may be one of the first input circuit 11*a*, the second input circuit 11*b*, and the third input circuit 11*c*. Here, in the case where a branch is simultaneously input with the selection signal and the lighting signal, the branch can be turned on and output a high-level signal as the second control signal. The control circuit 30 can determine the branch selected and turned on at each moment when the selection signal being generated. Therefore, when the output signal of the photoelectric selection signal control circuit 10 is received at that moment, the branch corresponding to the output signal being output can be determined, so that in the case where the output signal is a high-level signal, the selection signal can be continuously provided to that branch to enable the branch to be continuously turned on.

For example, in the case where the output signal of the photoelectric selection signal control circuit 10 is a low-level signal, the control circuit 30 sequentially provides selection signals to the first input circuit 11*a*, the second input circuit 11*b*, and the third input circuit 11*c*. In the case where the output signal of the photoelectric selection signal control circuit 10 is a high-level signal, the process of generating the cycle selection signals by the control circuit 30 is interrupted, the selection signal is only continuously output to the branch currently determined, and the decoding process is started.

For example, the control circuit 30 is further configured to continuously receive the output signal and decode the output signal to obtain the authentication information and start the display control function, such as the label control function. Here, when the selection signal input to the branch allows the branch to be continuously selected and turned on, the output signal is only controlled by the lighting signal. That is, when a lighting signal is input to the phototransistor of the branch, the output signal of the photoelectric selection signal control circuit 10 is a high-level signal; and when no lighting signal is input to the phototransistor of the branch, the output signal of the photoelectric selection signal control circuit 10 is a low-level signal, so that the output signal can be changed by the change of the external lighting signal. In addition, the information provided by the output signal includes the information of the lighting signal, so that by encoding the lighting signal, the output signal that is output can include a series of corresponding coded signals, and then the required authentication information can be decoded from the coded signals. When the authentication information is authenticated, the display control function can be started to perform corresponding display control operations, and for example, the label control function can be started to control the display state of the label.

For example, the control circuit 30 is configured to control the display state of the label according to the label control signal. For example, the display state includes the label position state and the label arrangement state.

For example, the display element 40 is used to display a corresponding label according to the display state. For example, if the label control signal is a control signal for controlling the label position state, operations such as movement of the label in the display region to change the label position state can be implemented according to the content of the label control signal. If the label control signal is a control signal for controlling the label arrangement state, operations such as rearranging the label in the display region to change the label arrangement state can be implemented according to the content of the label control signal.

For example, in some embodiments of the present disclosure, the signal receiving circuit 20 and the display element 40 can be implemented as touch display screens. For example, the label control signal received by the signal receiving circuit 20 may be a touch signal. Alternatively, in some other embodiments of the present disclosure, the method in which the signal receiving circuit 20 receives the label control signal may also be implemented by remote-control methods such as Bluetooth or infrared control, and the label control signal may be a remote-control signal or the like. The embodiments of the present disclosure are not limited in this aspect.

It can be seen from the above-mentioned embodiments that the display device provided by the embodiments of the present disclosure enables the photoelectric selection signal control circuit to have only one branch to be selected and turned on by the selection signal at a certain moment, and scans each of the branches in a sequential selection manner to determine whether any photosensitive circuit in the branches receives the lighting signal. When it senses that there is a lighting signal in a branch, the control circuit is used to keep the branch selected until the end of data information transmission. This method ensures that the control circuit can determine the specific branch to be selected and turned on, and further receive the output signal of the photoelectric selection signal control circuit under the control of the lighting signal to obtain encoded data formed by the output signal, so that the verification function is implemented based on the encoded data to enable the user to control the display of the display element, for example, enable the user to operate the label displayed by the display element.

In the case where the display device provided by the embodiments of the present disclosure is used for displaying the label, the display state of the label can be controlled in combination with the photoelectric selection signal control circuit provided by the embodiments of the present disclosure. For example, the display element of the display device may be a strip-shaped screen, the display region of the strip-shaped screen may be used to display a plurality of labels, and the display state of the label corresponding to a certain branch in the display region is controlled by the photoelectric selection signal control circuit, for example, the photoelectric selection signal control circuit is used to select a corresponding label and decode the output signal corresponding to the label. Thus, the technical problem of setting the display position of the label in the display device using the strip-shaped screen as the display element is solved, and the effect of conveniently moving the label in the display region is achieved, thereby solving the more complicated technical problems such as selection and display location setting when the user set electronic labels (for example, price labels) in real time in a supermarket scene, and facilitating practical application.

The working process of the display device provided by the embodiments of the present disclosure is described below in connection with FIG. 4 and FIG. 5B.

For example, the selection signal generated by the control circuit 30 sequentially selects and turns on each branch in the photoelectric selection signal control circuit 10 (for example, allows each signal control circuit of the photoelectric selection signal control circuit 10 to be turned on in turn). When a phototransistor of a branch receives a lighting signal, the level of the second control signal output by the phototransistor is higher than the set threshold value, so that the comparison result signal output by the comparator of the branch is a high-level signal, for example, the high-level signal may be represented as "1". When the comparison result signal output by the comparator of any branch is "1", the output signal of the OR gate U1 is a high-level signal, for example, represented as "1". Thus, the control circuit 30 receives the high-level output signal with the output of "1", so that the aforementioned sequential selection process is interrupted, and the selection signal is continuously transmitted to the input circuit of the branch that outputs the "1" signal to allow the branch to be continuously turned on. The lighting signal received by the phototransistor (for example, the lighting signal output from the device, generating the lighting signal, to the phototransistor) is converted into a control signal through the output circuit, and the control circuit 30 receives the control signal and completes subsequent decoding operations, thereby obtaining the authentication information by analyzing the output signal. When the authentication information is authenticated, the display device starts the display control function, for example, starts the label control process, thereby completing the control of the display state of the label according to the label control signal.

In the whole control process, there is only one branch being selected and turned on at a certain moment in the photoelectric selection signal control circuit, and the sequential selection method is adopted to scan each of the branches of the photoelectric selection signal control circuit to determine whether any branch receives the lighting signal. When a branch senses the lighting signal, the selection of the branch may be maintained until the end of transmission of the output signal. This method ensures that the decoder can determine which branch in the photoelectric selection signal control circuit is selected and turned on, thereby achieving the control of the display state of the label corresponding to the branch.

For example, the output signal includes a preamble code, a synchronization code, a data code, and a verification code. The preamble code is used to start the decoding step to ensure that the controlled branch is selected and turned on, the synchronization code is used to ensure synchronization of timing, the data code includes data information to be transmitted, and the verification code is used to verify whether the transmitted data information is correct. For example, the verification code may be one of a group consisting of the inverse code of the data code, a cyclic redundancy check (CRC) code, and the like. It should be noted that the output signal is from the lighting signal, and therefore, the composition of the lighting signal also conforms to the arrangement regulations of the output signal, that is, including the preamble code, the synchronization code, the data code, and the verification code. Details are not described herein again.

For example, when the data code is transmitted by the output signal, the data "1" can be set as a high level, and the data "0" can be set as a low level. Therefore, when a branch is selected and turned on, the phototransistor in the branch is turned on under the control of the lighting signal, the second control signal provided to the non-inverting input terminal of the comparator is a high-level signal, and the high-level signal is output to the control circuit through the OR gate U1 for decoding. Because only one branch is selected and turned on in the photoelectric selection signal control circuit at one moment, it is possible to reduce or avoid the interference of data transmission of other branch signals at the same time, and improve the reliability of the transmitted data information.

For example, the lighting signal may be generated and sent by a handheld control device, and the lighting signal is associated with the identity information or authentication information of the user who holds or uses the handheld control device, thereby enabling the output signal received by the control circuit to include the authentication information through the lighting signal.

Because the control circuit can determine the certain branch currently being selected and turned on by the selection signal, the data code transmitted through the output signal may be used as identity authentication information. For example, the handheld control device may be assigned to the permanent staff, so that the data code can be added to the system. Only the added data code can complete control operations, and the data code may be decoded and stored in the operation log during each operation. This method is not only convenient for the user to use, but also allows the user to complete the movement and selection of the display label by a direct control manner and further achieves the functions of identity authentication and the preservation of the operation log, thereby improving the convenience and reliability of the display device when being used for displaying the electronic label.

Hereinafter, the structure of the display device illustrated in FIG. 5B will be described by taking the strip-shaped display screen illustrated in FIG. 6A to FIG. 6E as the display element as an example.

Figure 6A:
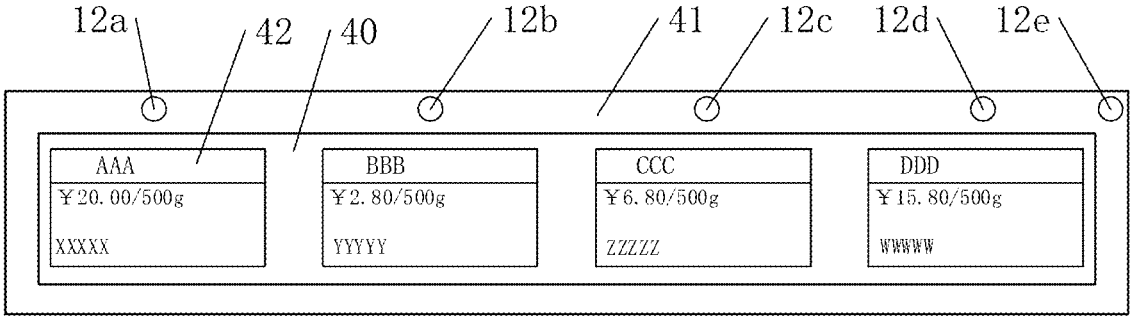
FIG. 6A is a schematic structural diagram of a display device provided by some embodiments of the present disclosure.

For example, as illustrated in FIG. 6A, the display device includes a display element 40 (for example, a display screen), and a plurality of labels 42 can be displayed on the display element 40. The positions of the frame 41 of the display element 40 corresponding to the labels 42 are respectively provided with exposed photosensitive circuits 12*a*, 12*b*, 12*c*, and 12*d*, and a corner of the frame 41 is further provided with a photosensitive circuit 12*e*. For example, the above-mentioned photosensitive circuits 12*a*, 12*b*, 12*c*, and 12*d* are respectively included in the branches inside the photoelectric selection signal control circuit 10 to implement the receiving of the lighting signals of the photosensitive circuits in the branches of the photoelectric selection signal control circuit 10.

For example, the contents of the settings and functions of the photosensitive circuits 12*a*, 12*b*, 12*c*, 12*d*, and 12*e* described above may refer to the descriptions of the photosensitive circuit in the embodiments of the photoelectric selection signal control circuit 100 and the photoelectric selection signal control circuit 200, which are not repeated here for simplicity.

For example, in the display region of the display element 40 in FIG. 6A, except for the positions used to display the labels, the remaining positions may be set to display a background picture or be inserted with an image such as a dynamic advertisement, so that the display region of the display element 40 can be fully utilized, for example, the strip-shaped display characteristics of the strip-shaped screen can be fully utilized.

For example, the display element 40 is used to display a plurality of labels, and the photosensitive circuits of the photoelectric selection signal control circuit 10, such as the photosensitive circuits 12*a*, 12*b*, 12*c*, and 12*d*, are respectively provided corresponding to the positions of the labels, so as to control the display states of the plurality of labels in the display region.

For example, the display state includes the label position state.

For example, the control circuit 30 of the display device may be used to determine the corresponding photosensitive circuit according to the input circuit, selected at the current moment, of the photoelectric selection signal control circuit 10, and determine the corresponding label 42 controlled by the label control signal according to the position of the photosensitive circuit. For example, referring to FIG. 6B, where the branch where the photosensitive circuit 12*b* is located is turned on, the display state of the label corresponding to the photosensitive circuit 12*b*, that is, the label including the content information of "BBB", is changed. For example, "BBB", "YYYYY", etc. displayed on the label may be, for example, merchandise information such as merchandise name, price, place of production, specifications, etc., and the embodiments of the present disclosure are not limited in this aspect.

For example, the control circuit of the display device can control the label position state of the label 42 according to the label control signal to implement the control of the label position.

For example, the display element 40 can display the corresponding label according to the label position state. For example, referring to FIG. 6C, the display state of the label 42 which is selected in FIG. 6B can be controlled according to the label control signal, for example, changing the display position of the label 42 in the display region.

Figure 6B:
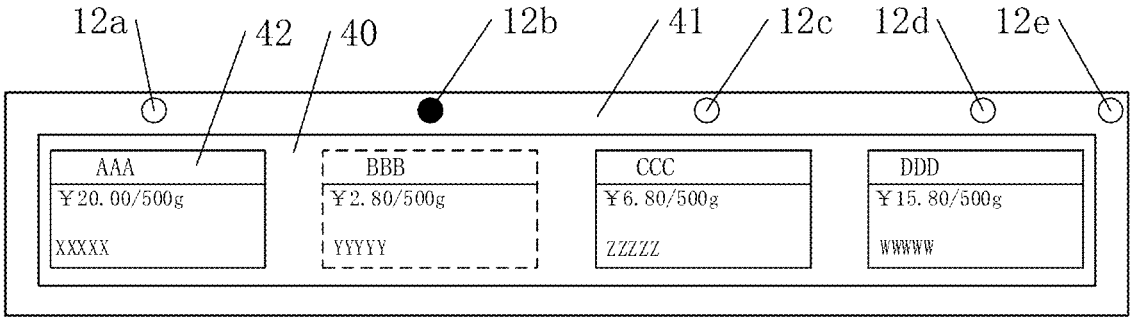
FIG. 6B is a schematic diagram of the display device in a label position state provided by some embodiments of the present disclosure.

For example, the branch where the photosensitive circuit 12*b* is located can be turned on by applying the lighting signal to the photosensitive circuit 12*b*, so as to select the label 42 corresponding to the photosensitive circuit 12*b*. For example, as illustrated in FIG. 6B, the label 42 corresponding to the photosensitive circuit 12*b* is displayed being selected in the display region. For example, the border of the label 42 may be displayed as a dashed line as illustrated in FIG. 6B to show that the label is selected. Alternatively, in some other embodiments of the present disclosure, the border of the label 42 may also be displayed as a curve, a broken line, or other suitable forms to show that the label 42 is selected, and the embodiments of the present disclosure are not limited in this aspect.

Figure 6C:
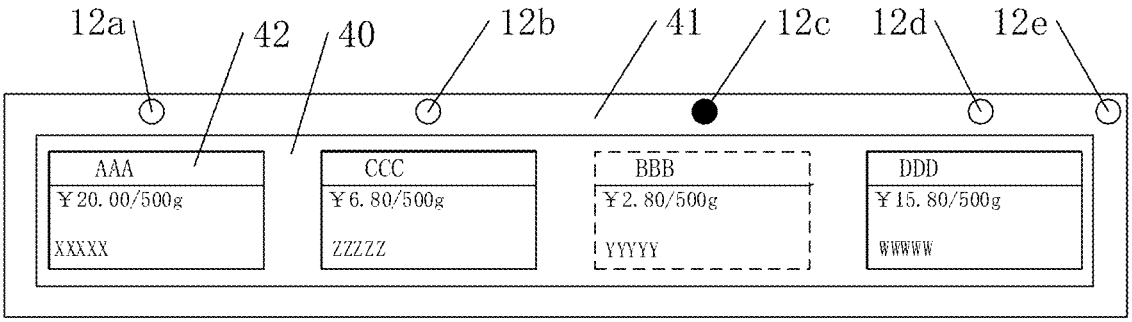
FIG. 6C is a schematic diagram of the display device after move of the selected label in FIG. 6B.

For example, FIG. 6C illustrates the display state of the display label selected in FIG. 6B after the label position is changed according to the label control signal. The display element 40 displays that the selected label moves from the position illustrated in FIG. 6B to the position illustrated in FIG. 6C, so as to achieve the movement of the display label.

In this way, by applying the lighting signal to the photosensitive circuit at the specific position in the display device, the display state of the label corresponding to the photosensitive circuit can be controlled, thereby implementing the change of the display position of the label, for example, moving the label to other positions in the display region.

Figure 6D:
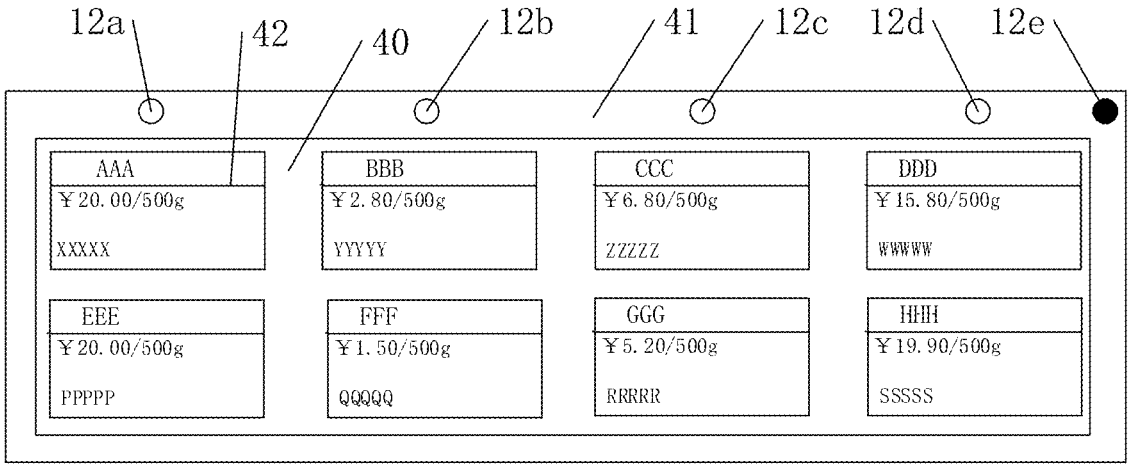
FIG. 6D is a schematic diagram of a display device in a label arrangement state provided by some embodiments of the present disclosure.
Figure 6E:
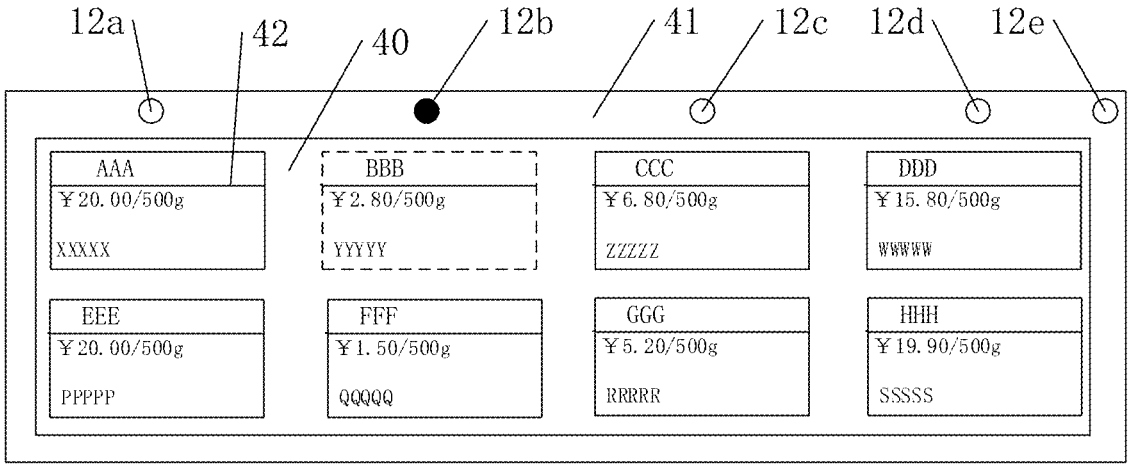
FIG. 6E is a schematic diagram of selecting a display label in the label arrangement state of the display device provided by some embodiments of the present disclosure.

For example, as illustrated in FIG. 6D, the photosensitive circuit 12*e* is provided on one side of the display element 40. The display state of the label includes the label arrangement state.

For example, the control circuit 30 can be used to control the label arrangement state of the label 42 according to the label control signal if the photosensitive circuit corresponding to the input circuit of the photoelectric selection signal control circuit 10 selected at the current moment is the photosensitive circuit 12*e* provided on one side of the display element 40.

For example, the display element 40 may display the label 42 according to the label arrangement state. For example, referring to FIG. 6D and FIG. 6E, where the branch where the photosensitive circuit 12*e* is located is turned on, the label 42 displayed on the display element 40 is in the label arrangement state, so that in the label arrangement state, the display state of each label 42 can be controlled through the photosensitive circuit corresponding to the each label 42.

In this way, the labels in the display region can be rearranged by applying the lighting signal to the photosensitive circuit on one side of the display element. With this arrangement function, selectable display labels can be arranged in the display region through the display element 40 for the user to quickly select.

In the above-mentioned embodiments of the present disclosure, the display element 40 may be a liquid crystal panel, a liquid crystal television, an OLED panel, an OLED television, a display, an electronic paper display device, a mobile phone, a tablet computer, a notebook computer, a digital photo frame, a navigator, and other products or components having display functions. The embodiments of the present disclosure are not limited in this aspect.

In the above-mentioned embodiments of the present disclosure, the signal receiving circuit 20 and the control circuit 30 may be processors which implement corresponding functions through a processing unit with data processing capabilities and/or instruction execution capabilities in combination with corresponding computer instructions. For example, the signal receiving circuit 20 and the control circuit 30 may be general-purpose processors, such as a central processing unit (CPU), and implement corresponding functions by executing computer instructions, which are represented as computer software in logic and form. For example, the signal receiving circuit 20 and the control circuit 30 may also be dedicated processors, which implement corresponding functions through firmware or coded instructions, such as the field programmable gate array (FPGA), application specific integrated circuit (ASIC), digital signal processor (DSP), etc. The embodiments of the present disclosure are not limited in this aspect.

In the above-mentioned embodiments of the present disclosure, the signal receiving circuit 20 and the control circuit 30 may be composed of elements such as transistors, resistors, capacitors, amplifiers, etc., or may also be implemented by signal processors such as the FPGA, DSP, MCU, etc., or may also include a processor and a memory, where the processor can execute the software program stored in the memory to achieve the corresponding functions. The embodiments of the present disclosure are not limited in this aspect.

At least one embodiment of the present disclosure further provides a control device, and the control device includes a trigger circuit, a signal generation circuit, and a signal sending circuit. The trigger circuit is configured to receive a trigger instruction from a user and send out a trigger signal, the signal generation circuit is configured to generate a lighting signal based on a preset code according to the trigger signal, and the signal sending circuit is configured to transmit the lighting signal to a photosensitive circuit of a photoelectric selection signal control circuit.

For example, the control device provided by the embodiments of the present disclosure can be configured to provide the lighting signal to the photosensitive circuit of the photoelectric selection signal control circuit provided by any one of the embodiments of the present disclosure, such as the photoelectric selection signal control circuit 100 or the photoelectric selection signal control circuit 200 in the above-mentioned embodiments.

Figure 7:
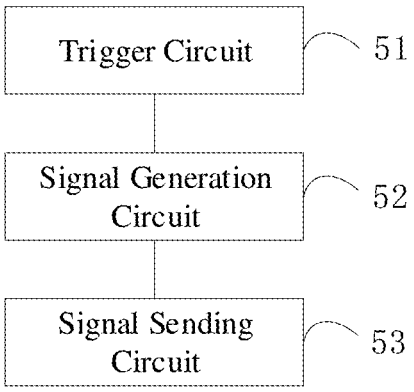
FIG. 7 is a schematic block diagram of a control device provided by some embodiments of the present disclosure.
Figure 8:
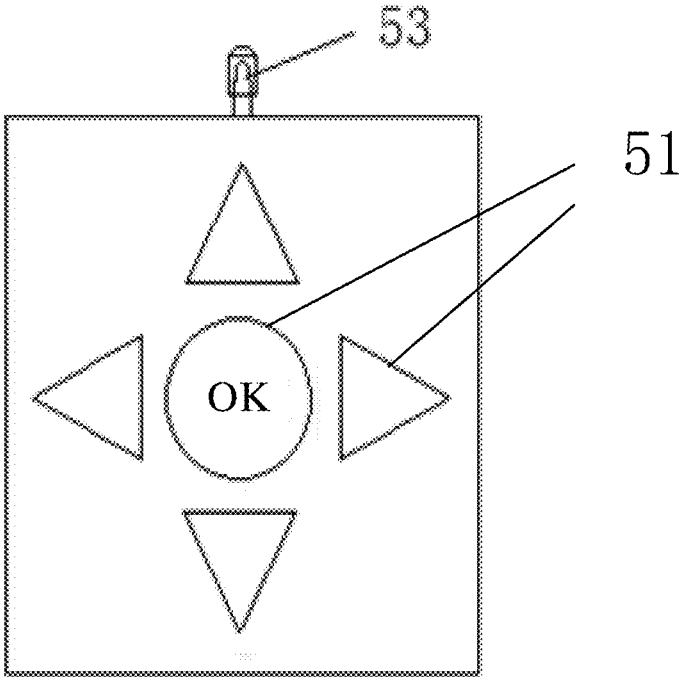
FIG. 8 is a schematic structural diagram of a control device provided by some embodiments of the present disclosure.

FIG. 7 is a schematic block diagram of a control device provided by some embodiments of the present disclosure, and FIG. 8 is a schematic structural diagram of a control device provided by some embodiments of the present disclosure.

For example, as illustrated in FIG. 7 and FIG. 8, the control device includes a trigger circuit 51, a signal generation circuit 52, and a signal sending circuit 53.

For example, the trigger circuit 51 is used to receive the trigger instruction from the user and send out the trigger signal.

For example, the trigger circuit 51 includes at least one button (as illustrated in FIG. 8), and the trigger signal is sent out when the button is pressed, so that one-key operation is achieved through the button.

For example, the signal generation circuit 52 is used to generate the lighting signal based on the preset code according to the trigger signal.

For example, the lighting signal includes a preamble code, a synchronization code, a data code, and a verification code. The preamble code is used to start the decoding step, the synchronization code is used to ensure synchronization of timing, the data code includes data information to be transmitted, and the verification code is used to verify whether transmitted data information is correct.

For example, the signal sending circuit 53 is used to transmit the lighting signal to the photosensitive circuit of the photoelectric selection signal control circuit.

The control device provided by the embodiments of the present disclosure can control the turn-on state of the photosensitive circuit of the photoelectric selection signal control circuit by generating and outputting the lighting signal. For example, the photoelectric selection signal control circuit can be the photoelectric selection signal control circuit provided by any one of the embodiments of the present disclosure. Therefore, the control device can cooperate with the display device provided by the embodiments of the present disclosure to achieve the verification function such as identity authentication, thereby further enabling the display device to achieve the technical effects of simple operation and convenient use.

In some embodiments of the present disclosure, the control device includes only one button, and this one button guarantees the direct operation that what you see is what you get, so as to facilitate reducing incorrect operations and improve the accuracy of operations. In some other embodiments of the present disclosure, the control device may include more functions through the combination of more buttons. For example, as illustrated in FIG. 8, because of the addition of the operation combination of the buttons, the control device can be changed into remote control, so that more operation functions can be achieved. For example, in the case illustrated in FIG. 8, the data encoding of the lighting signal may further include a control code and an identity authentication code (the identity authentication code includes, for example, the preamble code, the synchronization code, the data code, and the verification code described above), which are not repeated here for simplicity.

For example, as illustrated in FIG. 8, the control device adopts a form of remote control. For example, a 5-button mode can be adopted. On the basis of an OK button, four buttons up, down, left and right are added respectively, so that the above four buttons can be used to achieve the fine adjustment of the label in the display region, such as the display position, thereby achieving the precise control of the display state of the label.

In addition, in the case where the display element of the display device adopts the strip-shaped screen, there is no need to set the fixed number of the electronic labels displayed in the display region, and more functions can be achieved by the addition and definition of the circuit being selected and turned on corresponding to the strip-shaped screen. For example, the display device may be used to drag more display labels in the display region, or drag the position of the display label, or enlarge or narrow the display label, etc. The above-mentioned functions can be achieved by adding selection circuits or by adding buttons (or multiplexing buttons) on a multi-function controller, which is not limited in the embodiments of the present disclosure.

In the above-mentioned embodiments of the present disclosure, the signal generation circuit 52 and the signal sending circuit 53 may be processors which implement corresponding functions through a processing unit with data processing capabilities and/or instruction execution capabilities in combination with corresponding computer instructions. For example, the signal generation circuit 52 and the signal sending circuit 53 may be general-purpose processors, such as a central processing unit (CPU), and implement corresponding functions by executing computer instructions, which are represented as computer software in logic and form. For example, the signal generation circuit 52 and the signal sending circuit 53 may also be dedicated processors, which implement corresponding functions through firmware or coded instructions, such as the field programmable gate array (FPGA), application specific integrated circuit (ASIC), digital signal processor (DSP), etc. The embodiments of the present disclosure are not limited in this aspect.

In the above-mentioned embodiments of the present disclosure, the signal generation circuit 52 and the signal sending circuit 53 may be composed of elements such as transistors, resistors, capacitors, amplifiers, etc., or may also be implemented by signal processors such as the FPGA, DSP, MCU, etc., or may also include a processor and a memory, where the processor can execute the software program stored in the memory to achieve the corresponding functions. The embodiments of the present disclosure are not limited in this aspect.

At least one embodiment of the present disclosure further provides a display system, and the display system includes the display device provided by any one of the embodiments of the present disclosure, and the control device provided by any one of the embodiments of the present disclosure.

The display system provided by the embodiments of the present disclosure can be used for label display, so as to simplify the verification method to a certain extent during label operation, allow the control method of the display system to be simple and convenient, and facilitate practical application.

For example, the display system provided by the embodiments of the present disclosure includes the display device provided by any one of the embodiments described above or the permutation and combination of the embodiments described above, and the control device provided by any one of the embodiments described above or the permutation and combination of the embodiments described above.

It can be seen from the above-mentioned embodiments that in the display system provided by some embodiments of the present disclosure, the photoelectric selection signal control circuit is enabled to have only one branch to be selected and turned on by the selection signal at a certain moment, and the input circuits in the branches are scanned in a sequential selection manner to determine whether any photosensitive circuit in the branches receives the lighting signal. When a branch of the photoelectric selection signal control circuit senses the lighting signal sent by the control device, the control circuit is used to keep the branch selected and turned on until the end of data information transmission. This method ensures that the control circuit can determine the specific branch to be selected and turned on, and further receive the output signal of the photoelectric selection signal control circuit under the control of the lighting signal, thereby forming the coded data according to the output signal, so that the verification function is implemented based on the coded data to enable the user to control the display of the display element, for example, operate the display state of the label.

In the display system provided by the embodiments of the present disclosure, the photoelectric selection signal control circuit can be combined to control the display of the display element, for example, the control method of the display state of the display label can be achieved. For example, the photoelectric selection signal control circuit can be used to control the display state of the label corresponding to one branch in the display region. For example, the photoelectric selection signal control circuit can be used to select the corresponding label and perform information decoding and other operations on the output signal corresponding to the label. Thus, in the case where the strip-shaped screen is used as the display element, the technical problems such as setting the position of the display label in the display region are solved, and the effect of conveniently moving the display label in the display region is achieved, thereby solving the more complicated technical problems such as artificial selection and display location setting when the staff set display labels (for example, price labels) in real time such as in the supermarket scene, and facilitating practical application.

In the above-mentioned embodiments of the present disclosure, the display system may be a liquid crystal panel, a liquid crystal television, an OLED panel, an OLED television, a display, an electronic paper display device, a mobile phone, a tablet computer, a notebook computer, a digital photo frame, a navigator, and other products or components having display functions. The embodiments of the present disclosure are not limited in this aspect.

At least one embodiment of the present disclosure further provides a display method applied to the display device provided by any one of the embodiments of the present disclosure. The display method includes using the control circuit to generate the selection signal and output the selection signal to the signal control circuit of the photoelectric selection signal control circuit, and using the control circuit to control the display element to display according to the output signal of the output circuit of the photoelectric selection signal control circuit.

The display method provided by the embodiments of the present disclosure may be, for example, applied to the display device provided by any one of the foregoing embodiments of the present disclosure. For example, when applied to a display device for label display, the display method provided by the embodiments of the present disclosure can simplify the verification method to a certain extent during label operation, thereby allowing the display method of the display device to be simple and convenient, and facilitating practical application.

In the display method provided by some embodiments of the present disclosure, the photoelectric selection signal control circuit includes a plurality of signal control circuits, and the selection signal selects and turns on an input circuit of only one signal control circuit of the plurality of signal control circuits at any moment. The display method further includes: using the control circuit to determine whether to start a decoding step at a current moment according to the output signal of the photoelectric selection signal control circuit, and using the control circuit to continuously generate and output the selection signal to an input circuit selected at the current moment and using the control circuit to continuously receive the output signal and decode the output signal to obtain authentication information and start a display control function after the decoding step is started.

Figure 9:
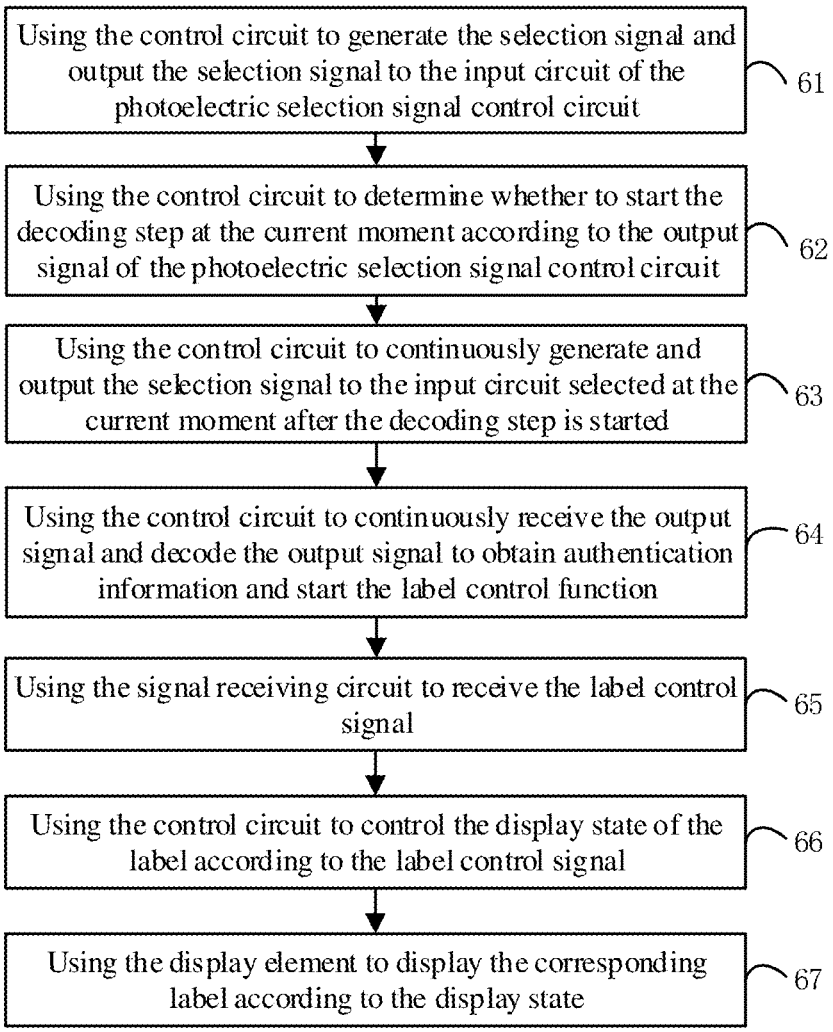
FIG. 9 is a schematic flowchart of an example of a display method provided by some embodiments of the present disclosure.

FIG. 9 is a schematic flowchart of an example of a display method provided by some embodiments of the present disclosure.

For example, as illustrated in FIG. 9, the display method includes the following steps.

Step 61: using the control circuit to generate the selection signal and output the selection signal to the input circuit of the photoelectric selection signal control circuit.

For example, the selection signal enables only one input circuit of the photoelectric selection signal control circuit to be selected and turned on at any moment.

Step 62: using the control circuit to determine whether to start the decoding step at the current moment according to the output signal of the photoelectric selection signal control circuit.

Step 63: using the control circuit to continuously generate and output the selection signal to the input circuit selected at the current moment after the decoding step is started.

Step 64: using the control circuit to continuously receive the output signal and decode the output signal to obtain authentication information and start the label control function.

Step 65: using the signal receiving circuit to receive the label control signal.

Step 66: using the control circuit to control the display state of the label according to the label control signal.

Step 67: using the display element to display the corresponding label according to the display state.

It can be seen from the above-mentioned embodiments that in in the case where the display method of the display device provided by the embodiments of the present disclosure is used for label display, the photoelectric selection signal control circuit is enabled to have the input circuit of only one branch to be selected and turned on (for example, only one input circuit is selected and turned on) by the selection signal at the same moment, and the branches of the photoelectric selection signal control circuit are scanned in a sequential selection manner to determine whether any photosensitive circuit in the branches receives the lighting signal. When it senses that a photosensitive circuit receives the lighting signal, the control circuit keeps the branch, where the photosensitive circuit is located, selected and turned on until the end of the data information transmission. This method ensures that the control circuit can determine the specific branch to be selected and turned on, and further receive the output signal of the photoelectric selection signal control circuit under the control of the lighting signal, thereby forming the coded data according to the output signal, so that the verification function is implemented based on the coded data to enable the user to control the display of the display element, for example, operate the display state of the label in the display region.

In the display method of the display device provided by the embodiments of the present disclosure, the photoelectric selection signal control circuit can be combined to control the display of the display element, for example, the control method of the display state of the display label can be achieved. For example, the photoelectric selection signal control circuit can be used to control the display state of the label corresponding to one branch in the display region. For example, the photoelectric selection signal control circuit can be used to select the corresponding label and perform information decoding and other operations on the output signal corresponding to the label. Thus, in the case where the strip-shaped screen is used as the display element, the technical problems such as setting the position of the display label in the display region are solved, and the effect of conveniently moving the display label in the display region is achieved, thereby solving the more complicated technical problems such as artificial selection and display location setting when the staff set display labels (for example, price labels) in real time such as in the supermarket scene, and facilitating practical application.

The following statements should be noted.

(1) The accompanying drawings involve only the structure(s) in connection with the embodiment(s) of the present disclosure, and other structure(s) can be referred to common design(s).

(2) In case of no conflict, features in one embodiment or in different embodiments can be combined to obtain new embodiments.

What have been described above are only specific implementations of the present disclosure, the protection scope of the present disclosure is not limited thereto. Any modifications or substitutions easily occur to those skilled in the art within the technical scope of the present disclosure should be within the protection scope of the present disclosure. Therefore, the protection scope of the present disclosure should be based on the protection scope of the claims.

What is claimed is:

1. A photoelectric selection signal control circuit, comprising an output circuit and at least one signal control circuit, wherein the signal control circuit is configured to output a comparison result signal under control of a selection signal and a lighting signal, and the output circuit is configured to output an output signal according to the comparison result signal, wherein the signal control circuit comprises:

an input circuit, configured to receive a first voltage signal and output a first control signal under control of the selection signal;

a photosensitive circuit, configured to output a second control signal according to the first control signal under control of the lighting signal; and a comparison circuit, configured to compare the second control signal with a second voltage signal different from the first voltage signal and output the comparison result signal.

2. The photoelectric selection signal control circuit according to claim 1, wherein the photosensitive circuit comprises a phototransistor, a collector electrode of the phototransistor is connected to the input circuit and configured to receive the first control signal, an emitter electrode of the phototransistor is connected to the comparison circuit and configured to output the second control signal, and a base electrode of the phototransistor is configured to receive the lighting signal.

3. The photoelectric selection signal control circuit according to claim 1, wherein the input circuit comprises a transistor, a control electrode of the transistor is configured to receive the selection signal, a first electrode of the transistor is configured to receive the first voltage signal, and a second electrode of the transistor is connected to the photosensitive circuit and configured to output the first control signal.

4. The photoelectric selection signal control circuit according to claim 1, wherein the comparison circuit comprises a comparator, a non-inverting input terminal of the comparator is connected to the photosensitive circuit and configured to receive the second control signal, an inverting input terminal of the comparator is configured to receive the second voltage signal, and an output terminal of the comparator is configured to output the comparison result signal.

5. The photoelectric selection signal control circuit according to claim 1, wherein the at least one signal control circuit comprises a plurality of signal control circuits, and the plurality of signal control circuits transmit comparison result signals output by the plurality of signal control circuits to the output circuit, respectively.

6. The photoelectric selection signal control circuit according to claim 5, wherein the plurality of signal control circuits are connected in parallel with each other.

7. The photoelectric selection signal control circuit according to claim 1, wherein the output circuit comprises an OR gate, an input terminal of the OR gate is connected to the signal control circuit and configured to receive the comparison result signal, and an output terminal of the OR gate is configured to output the output signal.

8. A display device, comprising a control circuit, a display element, and a photoelectric selection signal control circuit, wherein the photoelectric selection signal control circuit comprises an output circuit and at least one signal control circuit, the signal control circuit is configured to output a comparison result signal under control of a selection signal and a lighting signal, and the output circuit is configured to output an output signal according to the comparison result signal;

the control circuit is configured to generate the selection signal and output the selection signal to the signal control circuit of the photoelectric selection signal control circuit, and is configured to control the display element to display according to the output signal of the output circuit of the photoelectric selection signal control circuit; and the at least one signal control circuit comprises a plurality of signal control circuits, the selection signal selects and turns on an input circuit of only one signal control circuit of the plurality of signal control circuits at any moment, and the control circuit is configured to determine whether to start a decoding step at a current moment according to the output signal of the photoelectric selection signal control circuit, and is configured to continuously generate and output the selection signal to an input circuit selected at the current moment and continuously receive and decode the output signal to obtain authentication information and to enable a display control function in a case where the decoding step is started.

9. The display device according to claim 8, further comprising a signal receiving circuit, wherein the signal receiving circuit is configured to receive a label control signal;

the control circuit is configured to control a display state of a label according to the label control signal; and the display element is configured to display the label according to the display state.

10. The display device according to claim 9, wherein the display element is configured to display a plurality of labels, each label of the plurality of labels corresponds to one signal control circuit of the plurality of signal control circuits, and a position corresponding to the each label is provided with a photosensitive circuit of the one signal control circuit;

the display state comprises a label position state;

the control circuit is configured to determine a corresponding photosensitive circuit according to the input circuit selected at the current moment, determine a label corresponding to the label control signal according to a location of the photosensitive circuit, and control the label position state of the label according to the label control signal; and the display element is configured to display the label according to the label position state.

11. The display device according to claim 9, wherein a plurality of photosensitive circuits of the plurality of signal control circuits comprise a photosensitive circuit provided on one side of the display element;

the display state comprises a label arrangement state;

the control circuit is configured to control the label arrangement state of the label according to the label control signal if a photosensitive circuit corresponding to the input circuit selected at the current moment is the photosensitive circuit provided on the one side of the display element; and the display element is configured to display the label according to the label arrangement state.

12. The display device according to claim 8, wherein the output signal comprises a preamble code, a synchronization code, a data code, and a verification code, the preamble code is used to start the decoding step, the synchronization code is used to provide synchronization of timing, the data code comprises data information to be transmitted, and the verification code is used to verify whether transmitted data information is correct.

13. A control device, comprising:

a trigger circuit, configured to receive a trigger instruction from a user and send out a trigger signal;

a signal generation circuit, configured to generate a lighting signal based on a preset code according to the trigger signal; and a signal sending circuit, configured to transmit the lighting signal to a photosensitive circuit of a photoelectric selection signal control circuit, wherein the lighting signal comprises a preamble code, a synchronization code, a data code, and a verification code, the preamble code is used to start a decoding step, the synchronization code is used to provide synchronization of timing, the data code comprises data information to be transmitted, and the verification code is used to verify whether transmitted data information is correct.

14. The control device according to claim 13, wherein the trigger circuit comprises at least one button, and the button sends out the trigger signal when being pressed.

15. A display system, comprising the control device according to claim 13, and a display device, wherein the display device comprises a control circuit, a display element, and a photoelectric selection signal control circuit;

the photoelectric selection signal control circuit comprises an output circuit and at least one signal control circuit, the signal control circuit is configured to output a comparison result signal under control of a selection signal and a lighting signal, and the output circuit is configured to output an output signal according to the comparison result signal; and the control circuit is configured to generate the selection signal and output the selection signal to the signal control circuit of the photoelectric selection signal control circuit, and is configured to control the display element to display according to the output signal of the output circuit of the photoelectric selection signal control circuit.

16. A display method applied to the display device according to claim 8, comprising:

using the control circuit to generate the selection signal and output the selection signal to the signal control circuit of the photoelectric selection signal control circuit; and using the control circuit to control the display element to display according to the output signal of the output circuit of the photoelectric selection signal control circuit.

17. The display method according to claim 16, wherein the photoelectric selection signal control circuit comprises a plurality of signal control circuits, the selection signal selects and turns on an input circuit of only one signal control circuit of the plurality of signal control circuits at any moment, and the display method further comprises:

using the control circuit to determine whether to start a decoding step at a current moment according to the output signal of the photoelectric selection signal control circuit; and using the control circuit to continuously generate and output the selection signal to an input circuit selected at the current moment and using the control circuit to continuously receive and decode the output signal to obtain authentication information and enable a display control function after the decoding step is started.

* * * * *